US007710033B2

(12) United States Patent
Bettinelli et al.

(10) Patent No.: US 7,710,033 B2
(45) Date of Patent: May 4, 2010

(54) PLASMA PANEL COMPRISING CEMENT PARTITION BARRIERS

(75) Inventors: Armand Bettinelli, Coublevie (FR); Jean-Philippe Browaeys, Puteaux (FR)

(73) Assignee: Thomson Licensing

( * ) Notice: Subject to any disclaimer, the term of this patent is extended or adjusted under 35 U.S.C. 154(b) by 258 days.

(21) Appl. No.: 10/558,009

(22) PCT Filed: May 24, 2004

(86) PCT No.: PCT/EP2004/050905

§ 371 (c)(1),
(2), (4) Date: Aug. 14, 2006

(87) PCT Pub. No.: WO2004/107381

PCT Pub. Date: Dec. 9, 2004

(65) Prior Publication Data

US 2007/0024203 A1 Feb. 1, 2007

(51) Int. Cl.
*H01J 17/49* (2006.01)

(52) U.S. Cl. ..... 313/582; 313/583; 313/584; 313/585; 313/586; 313/587; 106/600; 106/692; 106/713; 501/17; 501/20; 501/124

(58) Field of Classification Search ..... 313/582–587; 106/600, 692, 713; 501/17, 20, 124
See application file for complete search history.

(56) References Cited

U.S. PATENT DOCUMENTS

2001/0012744 A1* 8/2001 Cathey et al. ..... 445/24
2002/0174683 A1 11/2002 Laborde et al.
2004/0060481 A1* 4/2004 Schlenoff ..... 106/802

FOREIGN PATENT DOCUMENTS

JP 3-151433 6/1991
JP 11-283512 10/1999
WO WO 00/36625 6/2000
WO WO 03/003398 A2 * 1/2003

OTHER PUBLICATIONS

Patent Abstracts of Japan, vol. 15, No. 378, Sep. 24, 1991 & JP 03-151433 (See Ref. AC).
Patent Abstracts of Japan, vol. 2000, No. 1, Jan. 31, 2000 & JP 11-283512 (See Ref. AD).
The Search Report Dated Dec. 9, 2004.

* cited by examiner

*Primary Examiner*—Nimeshkumar D Patel
*Assistant Examiner*—Thomas A Hollweg
(74) *Attorney, Agent, or Firm*—Robert D. Shedd; Harvey D. Fried; Patricia Verlangieri

(57) ABSTRACT

Display panel comprising two plates leaving between them a sealed space that is filled with a discharge gas and is partitioned into discharge cells bounded between these plates by barrier ribs made of a mineral material comprising a mineral binder based on a hydraulic binder, and a mineral filler. By using a hydraulic binder instead of a glassy mineral binder, the display panels may be manufactured at lower temperature.

7 Claims, 1 Drawing Sheet

PLASMA PANEL COMPRISING CEMENT PARTITION BARRIERS

FIELD OF THE INVENTION

The invention relates to a plasma display panel comprising two plates leaving between them a sealed space that is filled with a discharge gas and is partitioned into discharge cells bounded between these plates by barrier ribs forming an array.

DESCRIPTION OF THE PRIOR ART

Such a display panel serves generally for displaying images.

The cells are generally distributed in rows and columns. The barrier ribs generally extend at least between the columns, and sometimes also between the rows.

The height of the barrier ribs generally corresponds to the distance between the plates, so that the ribs also serve as spacers.

The sidewalls of the ribs and one of the plates are generally coated with phosphors capable of emitting visible light under the excitation of plasma discharges. By adapting the composition of the discharge gas, it is also possible to obtain visible light directly, without phosphors.

The manufacture of barrier ribs generally requires expensive and penalizing heat treatments.

Document WO 00/36625 discloses a manufacturing process in which the ribs are molded in an inverse polymer pattern produced by photolithography. To produce the ribs, that document describes on page 8, lines 7 to 22, the use of a molding paste comprising ceramic powders, glass frits, Portland cement or other metal oxide powders. The single example given at the end of the document specifically describes the use of a paste containing 40% cement by weight (page 10, line 32), and paraffin oil as carrier fluid. After molding, the paraffin oil migrates into the photocured material of the mold thereby increasing the density of the mineral powder in the channels of the mold. A final heat treatment at 600° C. removes the polymer and the paraffin oil from the mold, and causes the cement powder to solidify here by sintering. As may be seen in that document, water is added at no step of the process for manufacturing the cement ribs. For a person skilled in the art of barrier rib materials, this clearly means that the ribs are consolidated by sintering the cement powder or its decomposition products and not by a hydration action of the cement of the paste, the more so as, at 600° C., the cement hydration products would have become degraded if not decomposed to the point of preventing a consolidation effect.

SUMMARY OF THE INVENTION

One objective of the invention is to limit the number of heat treatments needed to obtain sufficient consolidation of the barrier ribs and/or to lower the temperature of these heat treatments or even to dispense with them.

For this purpose, the subject of the invention is a plasma display panel comprising two plates leaving between them a sealed space that is filled with a discharge gas and is partitioned to discharge cells bounded between these plates by barrier ribs made of a mineral material comprising a mineral binder and a mineral filler, characterized in that said mineral binder is a hydraulic binder.

According to the invention, the mineral binder is in the hydrated state and aggregates the mineral filler. To obtain this hydrated state, as will be illustrated below, it is therefore necessary to use water in the manufacturing steps for producing the plasma display panel. The hydraulic binder in the hydrated state that is responsible for consolidation of the barrier ribs, which binder aggregates the particles of the mineral filler, unlike the ribs described in document WO 00/36625 in which a person skilled in the art will have understood that the consolidation effect is obtained by sintering the cement powder particles (or ceramic powder) and in which, owing to the high treatment temperatures, the cement is no longer in the hydrated state.

The term "hydraulic binder" is understood to mean a material which, when it is formed en bloc from a powder, can be hardened by a hydration reaction. Thus, by blending a suitable mineral filler powder with a hydraulic binder powder, forming this powder blend for example by molding, the form obtained may be hardened after the hydration reaction. In practice, water is added to the powder blend before the entire liquid is poured into a mold. The addition of water constitutes what is generally called a mixing operation.

The cells of the display panel are generally divided up into rows and columns.

The barrier ribs generally extend at least between the columns, and also sometimes between the rows, in which case the ribs form a two-dimensional array. The height of the ribs generally corresponds to the distance between the plates.

The sidewalls of the ribs and one of the plates are generally coated with phosphors capable of emitting visible light under the excitation of the plasma discharges. By adapting the composition of the discharge gas, it is also possible to obtain visible light directly, without phosphors.

Such a plasma display panel generally comprises at least two arrays of electrodes placed so that each cell is crossed by one electrode of each array.

In general, each plate supports at least one array of electrodes, so that the electrodes of one array carried by one plate cross the electrodes of an array carried by the other plate.

Generally, at least one of the arrays is covered by a dielectric layer so as to provide a memory effect that makes it easier to drive the display panel.

Other plasma display panels do not include electrodes for initiating the discharges. Instead, microwave radiation is used to initiate the discharges. However, a single array of electrodes may be used in this case to address the discharges.

Preferably, the hydraulic binder is a cement, for example, one based on aluminates or aluminosilicates.

Preferably, the proportion by weight of mineral binder in the mineral material of the barrier ribs is equal to or greater than 50%.

Preferably, the mineral filler comprises more than 50% by weight of silica and/or alumina.

According to one embodiment, the porosity of the barrier ribs is equal to or greater than about 15%, preferably greater than 25%. Thus, during manufacture of the display panel, the pumping operation is facilitated.

BRIEF DESCRIPTION OF THE DRAWINGS

The invention will be better understood upon reading the description that follows, given by way of nonlimiting example, and with reference to the appended figures in which.

DESCRIPTION OF THE PREFERRED EMBODIMENTS

A first family of processes for manufacturing a plasma display panel according to the invention provided in this case with cells arranged in straight rows and columns, will now be described, specifying in particular the manufacture of the plate carrying the array of barrier ribs, which are also straight, in this case the back plate. In this first family of processes, it is conventional to use organic resins as temporary binders for forming the ribs. This requires a heat treatment to remove these binders.

Figure 2:
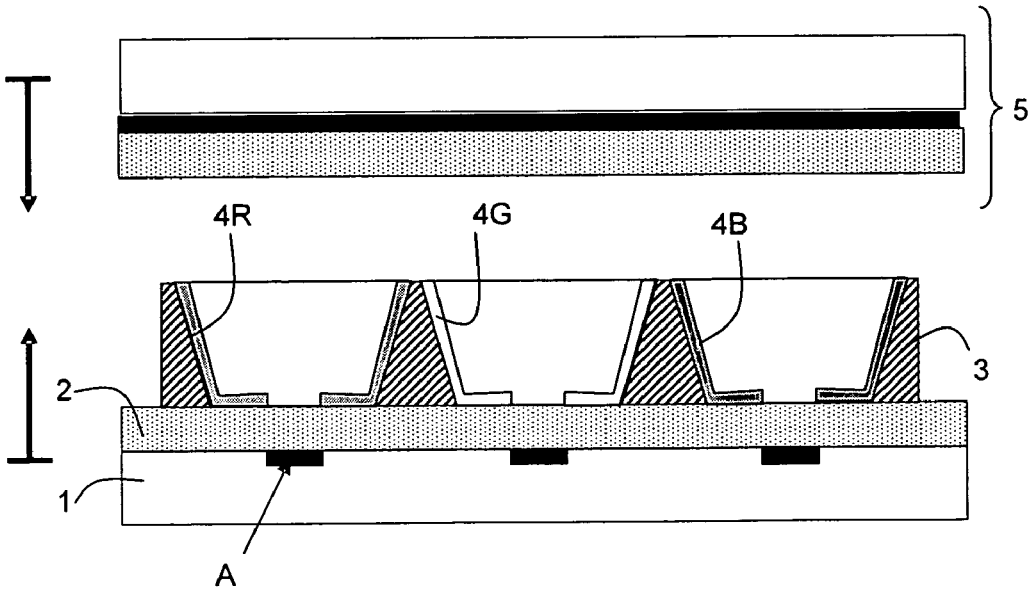
FIG. 2 illustrates a cross section of the display panel of FIG. 1, before the two plates are assembled.

Referring to FIG. 2, this shows a plate 1 made of soda-lime glass with dimensions of 254 mm×162 mm×3 mm and provided with an array of electrodes A formed by silver conductors, the array itself being coated with a conventional dielectric layer 2 baked at 540° C.

The manufacture of an array of barrier ribs 3 on this plate will now be described, so as to obtain

- ribs made of a mineral material based on a hardened hydraulic binder, here Portland cement;
- a series of continuous parallel ribs 60 to 70 μm in thickness, in order to separate the columns, these being spaced apart with a spacing of 360 μm; and
- a series of parallel ribs, 220 to 230 μm in thickness, for separating the rows, which are spaced apart with a spacing of 1080 μm.

Each of the cells thus bounded by these ribs has a rectangular shape with dimensions of approximately 850 μm×290 μm.

A paste is prepared, this being intended to form, after it has been applied to the plate and dried, a green rib layer comprising 4% organic binder by weight and 96% mineral rib material by weight. Here, based on cement:

- a Portland cement having quite a fine particle size is used, for example one having a mean particle diameter of the order of 1 μm. This cement is lightly laden with submicron silica powder called "silica fume"
- this cement is considered as rapid-setting cement;
- a solution comprising 8 g of resin based on ethyl cellulose in 92 g of terpineol-based solvent is prepared; and
- 200 g of powder of the mineral rib material, here cement, is dispersed in 104 g of resin solution. This dispersion is homogenized by passing it through a mixer/mill of the three-roll type, so as to reduce the size of the powder aggregates to less than 7 μm. If necessary, terpineol is added to adjust the viscosity to about 50 Pa·s.

Next, the rib paste is applied to the plate, in this case by screen-printing six superposed layers, each screen-printing pass being followed by a drying operation at 110° C. A plate provided with a green rib layer 150 μm in thickness is therefore obtained.

Preferably, in the case of the last two passes, a denser screen-printing cloth, for example having 90 threads/cm, is used, together with a less viscous paste, for example one with a viscosity of around 20 Pa·s, in order to obtain sub-surface smoothing layers at the surface of the rib layer.

According to one embodiment, the plate is coated with this paste, using a roll coater and the layer applied is dried in a tunnel oven through which the plate runs continuously, the oven being provided with air blowing and extraction means. A green layer of 150 μm in thickness can therefore be applied in a single pass.

The formation of the array of ribs, by abrasion, in the thickness of the green layer that has just been obtained will now be described.

Firstly, a protective mask is applied to this layer, the mask having apertures or features at the points where cells are to be hollowed out by abrasion in the thickness of the green layer. For this purpose:

- a dry photosensitive film about 40 μm in thickness is laminated at a suitable temperature and pressure on to the green layer;
- this film is irradiated at the locations of the ribs, with a UV light beam for a suitable period;
- next, this film is developed using a 0.2% sodium carbonate solution at about 30° C. so as to remove the film portions away from the locations of the ribs; and
- the assembly is rapidly dried so as to prevent the cement from setting.

In this way, a protective mask is obtained on the green layer.

To form the ribs in the thickness of the ribs, an abrasive material is blasted on to the mask using a nozzle with a linear slot 200 mm in length. As abrasive material, a metal powder sold by Fuji, with the reference S9 grade 1000, is used. During the blasting operation, the blasting nozzle is kept at about 10 cm from the plate and moved at a speed of about 50 mm/min along the barrier ribs to be formed, while the green plate during blasting moves in a direction perpendicular to that of the ribs at a speed of 70 mm/min. The blasting pressure is around 0.04 MPa; and the metal powder flow rate is about 2500 g/min.

Next, the mask is removed on the top of the green ribs just formed by spraying a 1% sodium hydroxide (NaOH) aqueous solution at 35° C. After rinsing with water and drying with an air knife at 50° C., what is obtained is a plate provided with an array of green ribs having a height of around 150 μm, a width of about 100 μm at the base and a width of about 70 μm at the top. These ribs comprise about 4% by weight of organic resin.

The application of layers of phosphors 4R, 4G, 4B by direct screen-printing of a phosphor paste in the cells formed between the green ribs will now be described.

The procedure is therefore as follows:

- preparation of phosphor pastes for the various colors by dispersing 60 g of phosphor powder in 140 g of a 3% ethyl cellulose solution in terpineol;
- use of a printing screen comprising a metal cloth having 120 threads per cm, this being sealed by a photosensitive emulsion except for bands 90 μm in width lying in the zones where the paste has to be transferred, that is to say regions spaced with a period of 1080 μm (3×360 μm) corresponding to the distance between two consecutive columns of cells of the same color;
- direct screen printing of one of the phosphor pastes through this screen, that is to say with localized paste transfer in the regions where the metal cloth has not been sealed; and
- drying at 120° C.

These operations are repeated for each primary color using the same screen, but this being offset, in the direction of the rows, by one column spacing (360 μm) for the second color and by a further period for the third color.

Next, a sealant paste is deposited around the perimeter of the back plate thus obtained. This sealant is based here on a fusible glass made as a paste in a cellulose solution giving a viscosity of the order of 100 Pa·s.

What is therefore obtained is a back plate provided with an array of green ribs, the sidewalls of which, between other surfaces, are coated with a green layer of phosphors.

A heat treatment is then carried out in order to remove the organic binder for the ribs and for the phosphor layers, consisting of a first temperature rise at 10° C./min up to 350° C., then a first hold for 20 minutes at 350° C., a second temperature rise at 10° C./min up to 480° C., then a second hold for 20 minutes at 480° C. and finally a fall in temperature at 10° C./min.

Next, the rib hardening treatment is carried out, which hardening is obtained according to the invention by a cement hydration reaction that therefore requires the use of water at this stage of the process. After the heat treatment, the plate obtained is made to run beneath a water spray for 30 minutes, the plate is then dried with an air knife at room temperature and then an air knife at 105° C. According to one way of carrying out the hardening treatment, the plate is immersed in water for 6 hours. According to another way of carrying out the hardening treatment, the plate is placed in pressurized steam at a suitable temperature and for a suitable time in order for the cement to harden, that is to say to set.

What is obtained is a back plate provided with an array of hardened ribs 3 coated with layers of phosphors 4R, 4G, 4B.

Since the heat treatment of the process that has just been described serves only to remove the organic binders and not to harden the ribs, as in the prior art, the duration of this treatment may advantageously be shortened, in particular by reducing the hold time, or even by increasing the rates of temperature rise within certain temperature ranges. Using glassy mineral binders as in the prior art, the hold times needed would be around 30 minutes instead of 20 minutes here. Shortening the heat treatment times, or even lowering the maximum temperatures during the treatment, represents a significant economic advantage.

According to one advantageous way of implementing the process, the operation of removing the organic binders and the operation of hardening the ribs are combined: first temperature rise at 10° C./min up to 350° C.; then the first hold for 30 minutes at 350° C.; passage in wet air, obtained by bubbling air into a water tank maintained at 80° C.; second temperature rise at 10° C./min up to 480° C.; second hold for 30 minutes at 480° C.; and, finally decrease in temperature at 10° C./min down to 350° C. and then passage in dry air until the plate has completely cooled.

To obtain a plasma display panel according to the invention, a conventional front plate 5 is joined to the back plate according to the invention (see the two arrows denoting the assembly in FIG. 2), the two plates are sealed by a 400° C. heat treatment, the air contained between the plates is pumped out, the display panel is filled with low-pressure discharge gas and the pumping aperture is sealed off. The front plate 5 conventionally comprises two arrays of coplanar electrodes X, Y.

Figure 1:
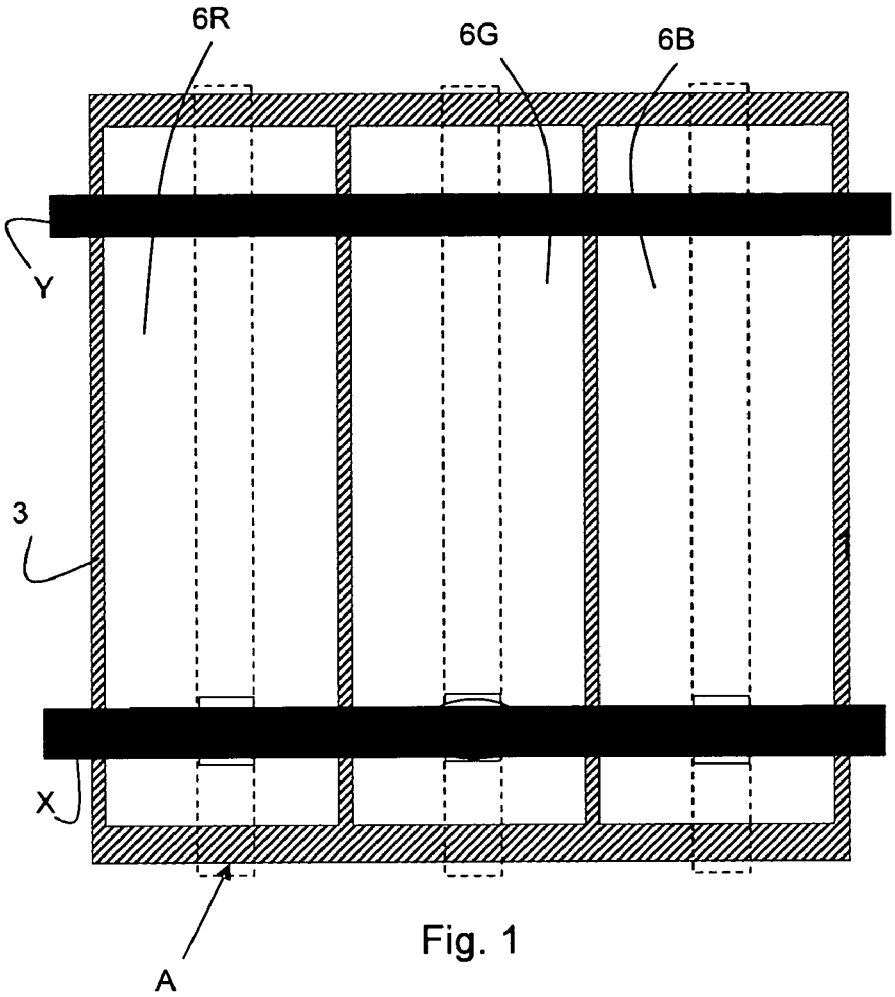
FIG. 1 illustrates, in a view from above, three adjacent cells of a plasma display panel according to one embodiment of the invention.

The plasma display panel thus obtained, shown in a view from above in FIG. 1, comprises two plates leaving between them a sealed space that is filled with a discharge gas and is partitioned into discharge cells 6R, 6G and 6B bounded by the barrier ribs 3 which, according to the invention, are made of a hardened mineral material, that is to say a material that is aggregated by a hydraulic binder that is in the hydrated state.

The plasma display panel thus obtained has good mechanical properties, especially at the ribs—no collapsing of the ribs is observed.

According to an advantageous method of implementation, instead of using a mineral material based on Portland cement, a mineral material that also contains a mineral filler, such as alumina or silica, or any other material compatible with the manufacture and the operation of a plasma display panel, may be used. The hydration of the hydraulic binder therefore serves, according to the invention, to aggregate this mineral filler.

According to one method of implementing the process that is particularly well suited for obtaining porous ribs, having an open porosity of greater than 25%, a mixture consisting of 50% of the cement described above and 50% of silica powder is used as mineral material for the ribs. For example, a cristobalite-type silica, whose specific surface area is less than 10 $m^2/g$ and whose mean particle size is less than 10 μm, typically around 5 μm, is used as silica. For example, silica with the reference M4000 from Sifraco is chosen. The ribs obtained also exhibit good mechanical properties. Thanks to the high degree of porosity of the ribs, the pumping time needed to extract the air contained between the plates is greatly shortened.

Another way of obtaining porous ribs with a porosity of greater than 25% will be to use foaming cement compositions well known to those skilled in the art of cements.

A second family of manufacturing processes for producing a plasma display panel according to the invention will now be described. In this second family of processes, there is no longer organic resins in the green rib layers. This completely dispenses with a high-temperature heat treatment, at least as regards the manufacture of the back plate.

The process starts with a 254 mm×162 mm×3 mm soda-lime glass plate provided with an array of electrodes formed by silver conductors, in this case the array not being coated with a dielectric layer.

The application of a slightly porous dielectric layer on this plate will now be described, together with the manufacture of an array of slightly porous ribs so as to obtain:

- ribs made of a mineral material based on a hardened hydraulic binder, here the same Portland cement as previously;
- a series of continuous parallel ribs 100 μm in thickness at the base and 70 μm at the top, in order to separate the columns, which are spaced apart with a spacing of 360 μm; and
- a series of parallel ribs, with a thickness of 260 μm at the base and 230 μm at the top, in order to separate the rows, which are spaced apart with a spacing of 1080 μm.

As previously, the cells of the panel are rectangular.

I—Preparation of the Pastes:

The following were prepared:

- a rib sublayer paste, intended to replace the dielectric layer of the previous embodiment;
- a rib paste.

I-a: Rib paste: this was an aqueous paste produced from a blend of 50% cement and 50% silica "mixed" with 35% water:

- 100 g of Portland cement powder obtained by milling, with selective sorting so as to limit the size of the coarsest particles to 11 μm ($d_{100}$<11);
- 100 g of a silica powder with a mean particle size of 3 μm ($d_{50}$=3 μm), in which the coarsest particle size was limited to 10 μm ($d_{100}$<10);
- dry blending of the two powders, followed by the incorporation of 109 g of deionized water, homogenization using a disperser and vacuum degassing.

A rib paste having a viscosity of 60 Pa·s was obtained.

I-b: sublayer rib paste: this was an aqueous paste consisting of a blend of 40% cement, 20% alumina and 40% titanium oxide "mixed" with 39% water:

- 80 g of quick-setting Portland cement powder, obtained by milling with selective sorting so as to limit the coarsest particle size to 11 μm ($d_{100}$<11);

40 g of alumina powder with a mean particle size of 3 μm ($d_{50}$=3 μm) in which the coarsest particle size was limited to 10 μm ($d_{100}$<10);

80 g of $TiO_2$ powder of 1.5 μm mean particle size ($d_{50}$=1.5 μm) in which the coarsest particle size was limited to 8 μm ($d_{100}$<10); and dry blending of the three powders, followed by the incorporation of 130 g of deionized water, homogenization using a disperser and vacuum degassing.

A sublayer paste having a viscosity of 40 Pa·s was obtained.

II—Application of the Sublayer and Formation of the Ribs:

1a) a mold was produced with an array of grooves having the geometry of the ribs, except that the depth of the grooves was increased by 20% over the height of these ribs. The mold consisted of a removable upper portion consisting of a shim whose thickness corresponded to the 20% additional thickness. The mold was coated with a mold-release agent and then placed on a vibrating pot. The mold was then filled with the freshly prepared rib paste and the surplus scraped off. The filled mold was then placed in an enclosure at 40° C. in order to speed up the setting reaction of the hydraulic binder, here cement. The setting of the cement corresponded to a cement hydration reaction;

1b) During setting, in parallel with step 1a), a 30 μm thick sublayer of sublayer paste was deposited by curtain coating on the plate and on the electrodes. The plate was then placed in a 50° C. environment in order to speed up the cement setting reaction in the sublayer; and 2) After setting for one hour in the mold (step 1a), the upper shim of the mold was removed so as to expose the upper surface of the mold that would constitute the base of the future ribs, and this surface was sprayed very lightly with water. Next, the back plate from step 1b) was applied to this surface so as to apply the still malleable sublayer against the base of the future ribs.

The whole assembly is then turned upside down so that gravity applies the mold and its ribs against the rear face and then the whole assembly is placed in a 40° C. environment.

After 2 hours, the demolding operation could be carried out, by removing the mold. This was then able to be cleaned with a high-pressure mold jet. The plate coated with its sublayer and its ribs was stored for a further 4 hours in a moisture-saturated atmosphere in order to complete the cement-setting reaction and thus obtain a hydraulic binder in the hydrated state which aggregates the mineral filler of the ribs and consolidates them. Next, the plate was passed through a tunnel oven regulated at 115° C. in order to remove the residual water.

Thus, an array of hardened and consolidated ribs was obtained without sintering and without heat treatment, these resting on a sublayer acting as dielectric layer; the porosity of the sublayer and of the ribs obtained was around 15%, this being advantageous for pumping the display panel. This porosity can be adjusted according to the water content of the paste.

III—Application of the Phosphors:

A suspension containing 70 g of phosphor powder dispersed in 130 g of a mixture of glycol ethers selected for their boiling point and their viscosity was prepared so as to place the phosphors in temporary suspension without using resins. Colloidal silica (or other) suspensions could, however, have been used as thickener if necessary.

To apply these pastes to the sidewalls of the ribs and to the bottom of the cells between these ribs, a paste dispensing method was employed, using syringes whose outlet orifices were directed between the ribs—for this purpose a multi-orifice head (comprising 76 calibrated holes 100 μm in diameter arranged in a staggered fashion, in a spacing of 1080 μm) was used. The head was moved parallel to the columns, in several offset passes in order to cover the entire plate, which was then dried at 120° C. In this way the three phosphors were applied in succession, with a shift of one column spacing (360 μm), as previously.

IV—Application of the Sealant:

Next, a sealant paste was deposited, using the same method of application as in the case of the phosphors, around the perimeter of the back plate thus obtained. This sealant was based in this case on a glass having a very low melting point formed as a paste solution similar to that for the phosphors, giving a viscosity of about 80 Pa·s. This was followed by a drying operation at 120° C.

V—Short Low-temperature Final Heat Treatment:

Despite there being no resin, the temperature was raised and held at 250° C. for 30 minutes in order to complete the evaporation of all the solvents.

To obtain a plasma display panel according to the invention, a conventional front plate was assembled on the back plate according to the invention, the two plates were sealed by a suitable heat treatment in order to at least partly fuse the sealant glass, the air contained between the plates was pumped out, the panel filled with low-pressure discharge gas and the pumping orifice sealed off.

The plasma panel thus obtained exhibited good mechanical properties, especially at the ribs. No collapsing of the ribs was observed. The hydraulic binder of the ribs remained in the hydrated state despite the heat treatment.

The process according to the second family of methods of implementing the invention therefore makes it possible to produce plasma display plates bearing the ribs without ever going beyond 250° C., this being economically very advantageous, the ribs being maintained in the hydrated state according to the invention.

According to an advantageous alternative implementation of the invention, a sealant based on a commercially available sealing adhesive resistant to a temperature of 250° C. may be used, allowing the two plates to be sealed by a heat treatment at only 250° C. In this case, thanks to the invention, no panel manufacturing steps are above 250° C. This makes it easier to keep the hydraulic binder of the ribs in the hydrated state, thereby advantageously limiting any risk of degrading the mechanical properties of the hydraulic binder of the ribs.

Whatever the method for implementing the invention, other types of cement than Portland cement may be used without departing from the invention, especially cements which, after setting, can withstand the temperatures of the heat treatments that are still necessary for manufacturing the display panel. Hydraulic binders of types other than cement may be used without departing from the invention.

The present invention applies to any type of plasma display panel whose cells are compartmentalized by ribs. These plasma display panels may be of the coplanar type, matrix type or radiofrequency or microwave excitation type.

The invention claimed is:

1. A plasma display panel comprising two plates having a sealed space between the two plates that is filled with a discharge gas, wherein the sealed space is partitioned into discharge cells bounded between the two plates by barrier ribs made of a mineral material comprising a mineral filler and a mineral binder, which aggregates said mineral filler, wherein said mineral binder is a hydraulic binder which is in the hydrated state so as to aggregate said mineral filler.

2. The display panel as claimed in claim 1, wherein said hydraulic binder is a cement.

3. The display panel as claimed in claim 2, wherein said cement is based on aluminates or aluminosilicates.

4. The display panel as claimed in claim 1, wherein the proportion by weight of mineral filler in said mineral material is equal to or greater than 50%.

5. The display panel as claimed in claim 1, wherein the mineral filler comprises more than 50% by weight of silica and/or alumina.

6. The display panel as claimed in claim 1, wherein the porosity of said barrier ribs is equal to or greater than 15%.

7. The display panel as claimed in claim 6, wherein the porosity of said barrier ribs is greater than 25%.

* * * * *